US005279466A

United States Patent [19]

Williams

[11] Patent Number: 5,279,466

[45] Date of Patent: Jan. 18, 1994

[54] ISOKINETIC SEPARATOR APPARATUS

[76] Inventor: Robert M. Williams, 16 La Hacienda, Ladue, Mo. 63124

[21] Appl. No.: 956,084

[22] Filed: Oct. 2, 1992

Related U.S. Application Data

[63] Continuation-in-part of Ser. No. 774,613, Oct. 10, 1991, abandoned.

[51] Int. Cl.[5] ..... B02C 23/32

[52] U.S. Cl. ..... 241/52; 241/79.1; 241/80; 209/139.1; 209/143

[58] Field of Search ..... 241/48, 52, 53, 57, 241/79.1, 80; 209/139.1, 143

[56] References Cited

U.S. PATENT DOCUMENTS

| | | | |
|---|---|---|---|
| 1,517,900 | 12/1924 | Gay | 209/139.1 X |
| 2,099,505 | 11/1937 | Weaver | 209/139.1 |
| 4,522,344 | 6/1985 | Morey | 241/79 |
| 4,566,639 | 1/1986 | Williams | 241/52 |
| 4,602,744 | 7/1986 | Williams | 241/30 |
| 4,641,788 | 2/1987 | Williams | 241/24 X |
| 4,673,134 | 6/1987 | Barthelmess | 241/79.1 X |
| 4,830,290 | 5/1989 | Williams | 241/59 |
| 4,993,647 | 2/1991 | Williams | 241/79.1 X |

*Primary Examiner*—Eugenia Jones

*Assistant Examiner*—Raymond D. Woods

*Attorney, Agent, or Firm*—Polster, Lieder, Woodruff & Lucchesi

[57] ABSTRACT

Apparatus for grinding material which comprises a flow of ground material that contains both desirable fines and undesirable oversize particles in which a separator rotor is equipped with shaped blades that isokinetically separate out the oversize particles and centrifuges such particles out of the path of the flow of ground material and into a path for returning the oversize particles for further grinding. The centrifuging of the oversize particles reduces the drag in the flow of the ground material into the separator rotor, and that reduces the horsepower needed to establish the movement of the ground material at a rate that improves the efficiency of the apparatus. A variation of the foregoing develops pressurization of the material in the separator zone so that the oversize ground material is forced to return to be subjected to further grinding under the influence of a differential pressure in the apparatus while the acceptable material is subject to micron sizing in the rotor. The apparatus further coordinates the operation of the rotor to air moving devices used to move the material through the apparatus.

4 Claims, 4 Drawing Sheets

FIG. 1.
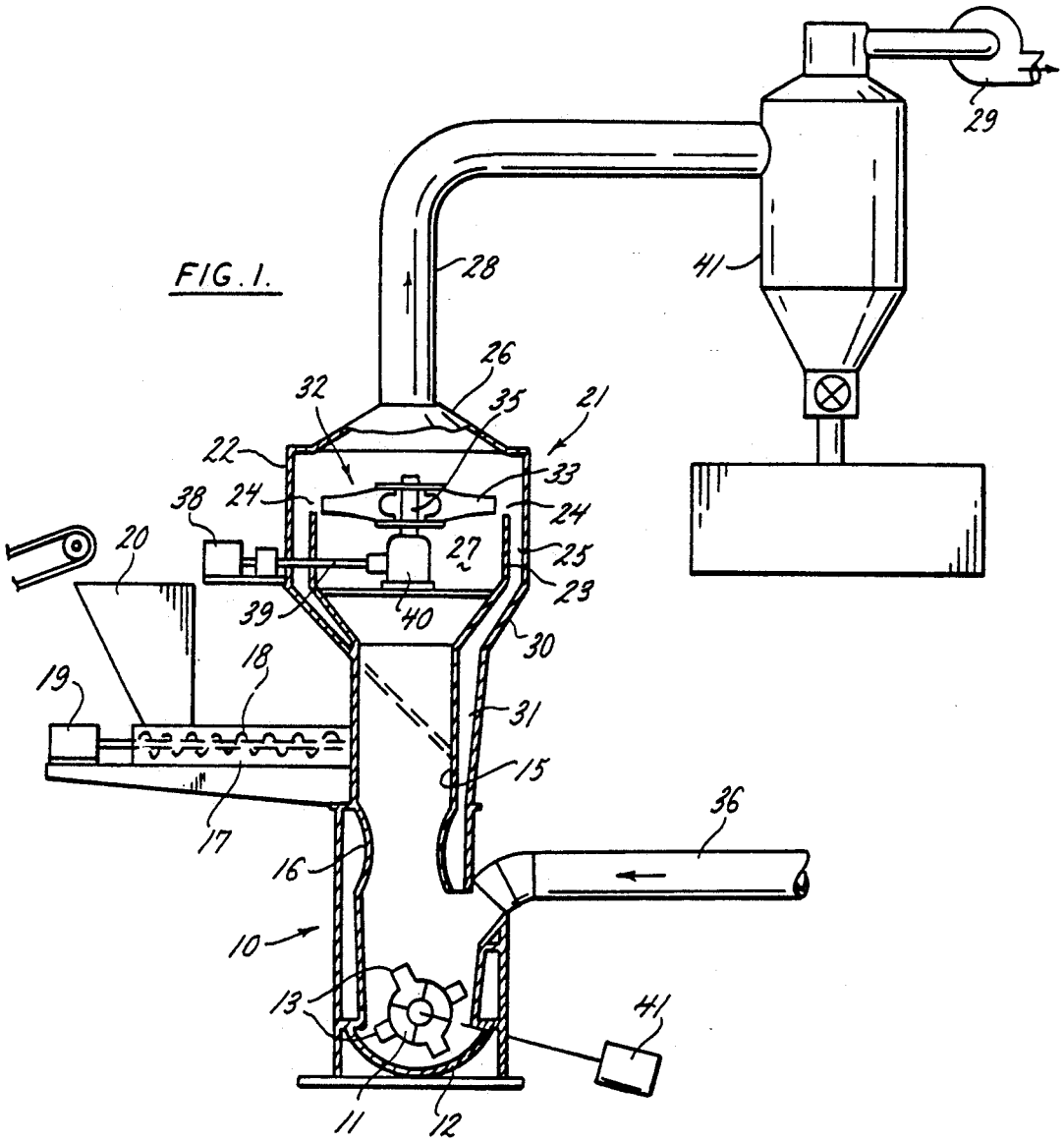
FIG. 2.
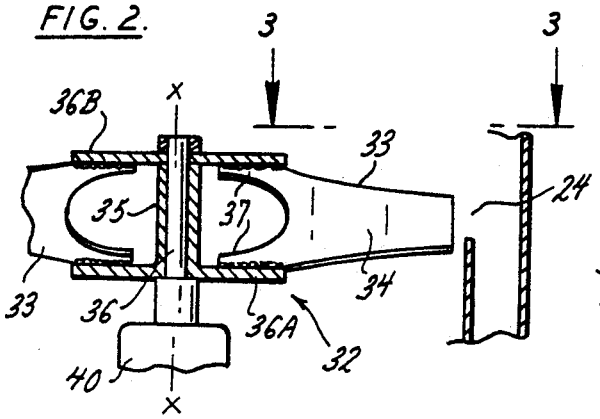
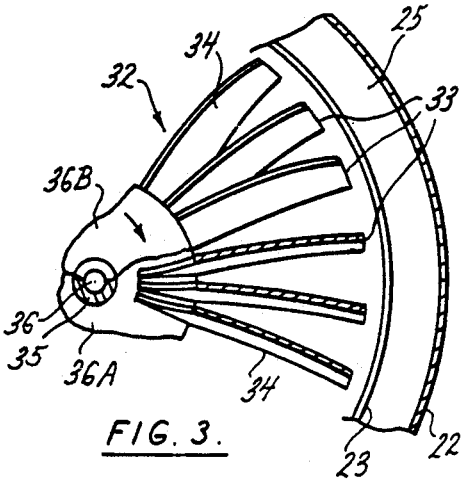
FIG. 3.

FIG. 4.
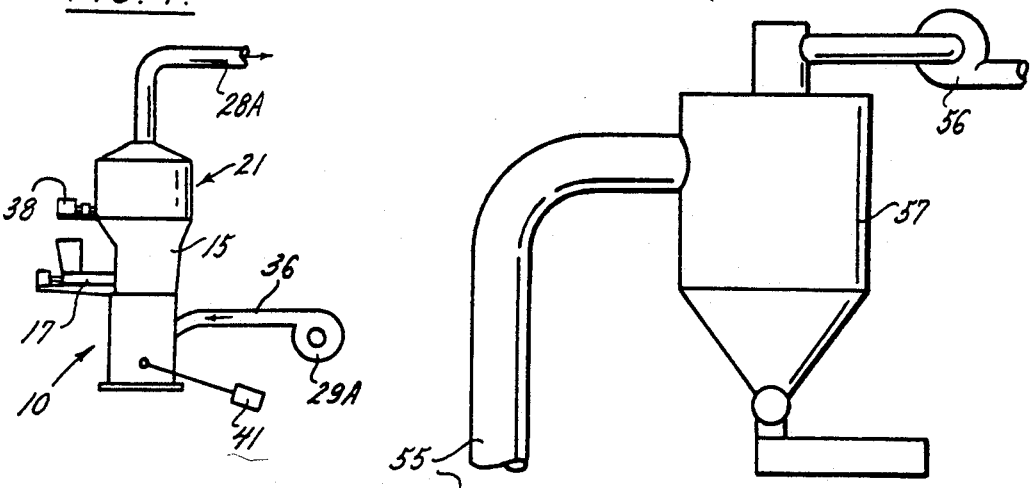
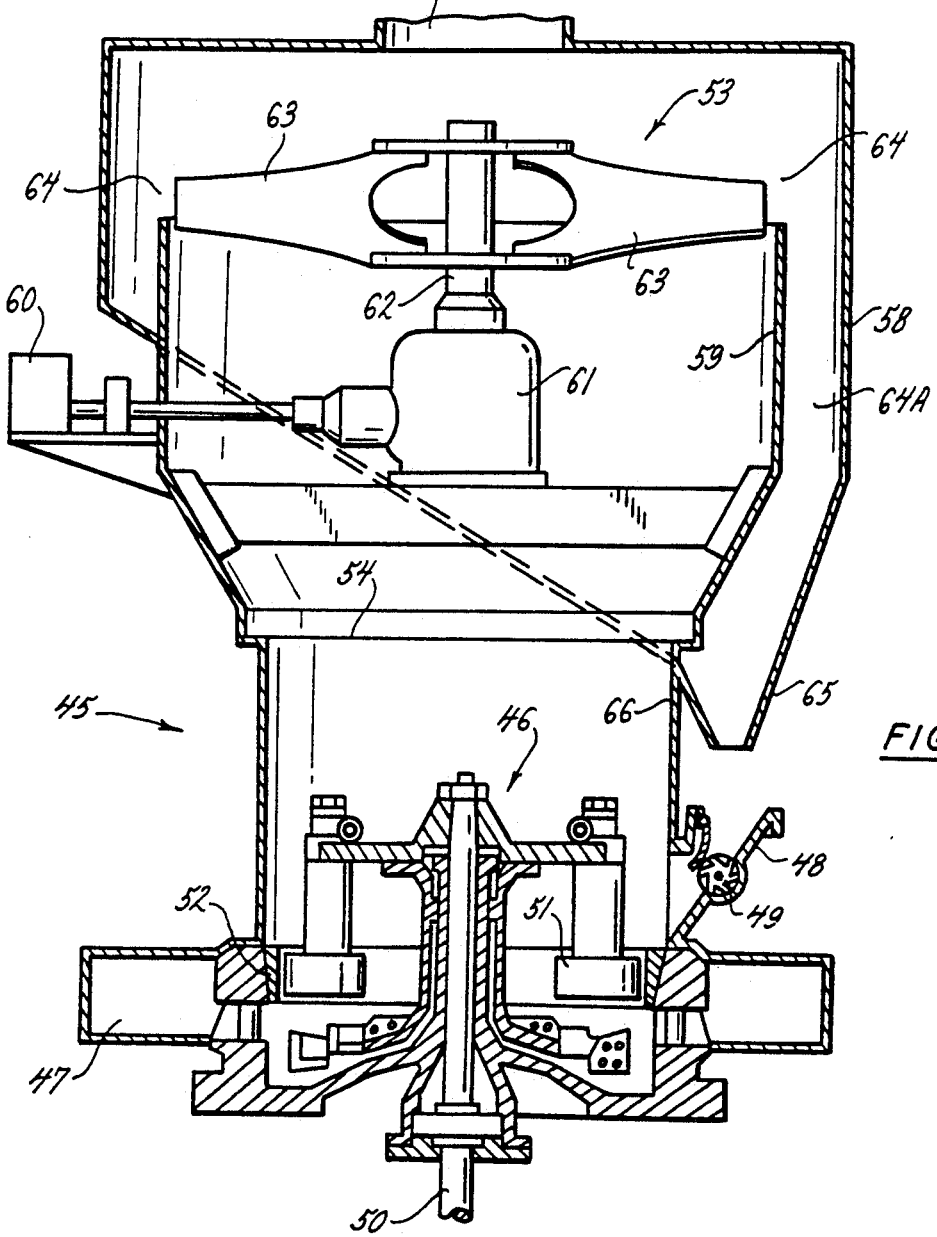
FIG. 5.

ISOKINETIC SEPARATOR APPARATUS

REFERENCE TO THE PRIOR APPLICATION

This application is related to, contains subject matter in common with, and is a continuation-in-part of Ser. No. 774,613, filed Oct. 10, 1991 entitled ISOKINETIC SEPARATOR APPARATUS, now abandoned.

BACKGROUND OF THE INVENTION

This application is a continuation-in-part of my copending application Ser. No. 744,613, filed Oct. 10, 1991.

1. Field of the Invention

This invention is directed to particle sortation in an isokinetic separator apparatus where oversize particles are selectively isolated from an air stream and returned in bypass of the apparatus for further reduction to micronized fineness.

2. Description of the Prior Art

In the processing of particulate material, like coal, rock and similar particulates that require reduction in size of the particles, apparatus has been created of the character shown in U.S. Pat. No. 4,993,647 of Feb. 19, 1991; U.S. Pat. No. 4,830,290 of May 16, 1991; U.S. Pat. No. 4,778,061 of Oct. 18, 1988; U.S. Pat. No. 4,641,788 of Feb. 10, 1987; U.S. Pat. No. 4,602,744 of Jul. 29, 1986; U.S. Pat. No. 4,566,639 of Jan. 28, 1986; and U.S. Pat. No. 4,522,343 of Jun. 11, 1985. Each of the apparatus disclosed in the foregoing prior art embodies either an impact hammer mill or a roller grinding mill in combination with an outlet connect into a motor driven separator of centrifugal or spinner classifying character.

The problem with the prior art is that the centrifugal separator device in the apparatus requires some form of motor drive which increases the horsepower consumption. In addition, the apparatus usually operates to classify the particulates in the grinding mill outlet for the purpose of separating the large particles, or those not sufficiently ground or reduced from a desired acceptable smaller micron particle size. Such apparatus has forced large particles to fall in counterflow to the incoming material, which counterflow interferes with and actually reduces the capacity of the apparatus while increasing the horsepower consumption to meet a desired output.

SUMMARY OF THE INVENTION

An object of this invention is to effect an efficient output of a desired particle size of material requiring reduction with the use of either an impact hammer mill or a roller grinding mill by providing means for redirecting the oversize portion of the material to follow a return path that is different from the upward flow of material from the mill so that the output from the mill is substantially free of being interfered with or obstructed in its movement by the returning of the oversize portion falling against the mill output particles in a counterflow relation.

A further important object of the invention is to provide apparatus having a zone in the mill outlet where the material being ground becomes responsive to a rotary separator device capable of sorting the ground material by the isokinetic action of the rotary device, and wherein there is created a pressure differential that allows the fine material to pass and forces the larger material to return to the mill for further grinding.

A further object of this invention is to provide apparatus for grinding material into micron size particles having a material grinding chamber, grinder means operably mounted in the grinding chamber, and means for admitting a flow of air into the grinding chamber, wherein an improvement therein comprises a casing structure connected to the grinding chamber and constituting an interior passage for the flow of ground material from the grinding chamber and an enclosure means surrounding at least a portion of said interior passage and extending above said interior passage to form a space having an opening communicating with the grinding chamber and an outlet opening to the exterior of said surrounding casing; a bladed impeller means operable in said space; drive means connected to said impeller means for pressurizing said space and causing said impeller to separate the ground material into micron size particles and larger particles responsive to the pressurization of said space and forced to flow through said opening communicating with the grinding chamber for further reduction.

A still further object of the invention is to provide a particulate material separator device with means for selectively sizing the material being processed.

Other objects of the invention will be set forth in more detail hereinafter.

DESCRIPTION OF THE DRAWINGS

The apparatus making up the subject matter of the invention comprises the several drawing views which include:

FIG. 1 is a schematic view of one embodiment of a material classifying system in which an impact or hammer mill is shown in fragmentary section;

FIG. 2 is an enlarged fragmentary sectional elevational view of a rotor blade seen in the mill of FIG. 1;

FIG. 3 is a plan view of a portion of the rotor seen along line 3—3 in FIG. 2;

FIG. 4 is a schematic view of another embodiment of a material classifying system similar to FIG. 1;

FIG. 5 is a further schematic view of an embodiment of a material classifying system employing a roller mill;

DETAIL DESCRIPTION OF THE APPARATUS

Figure 6:
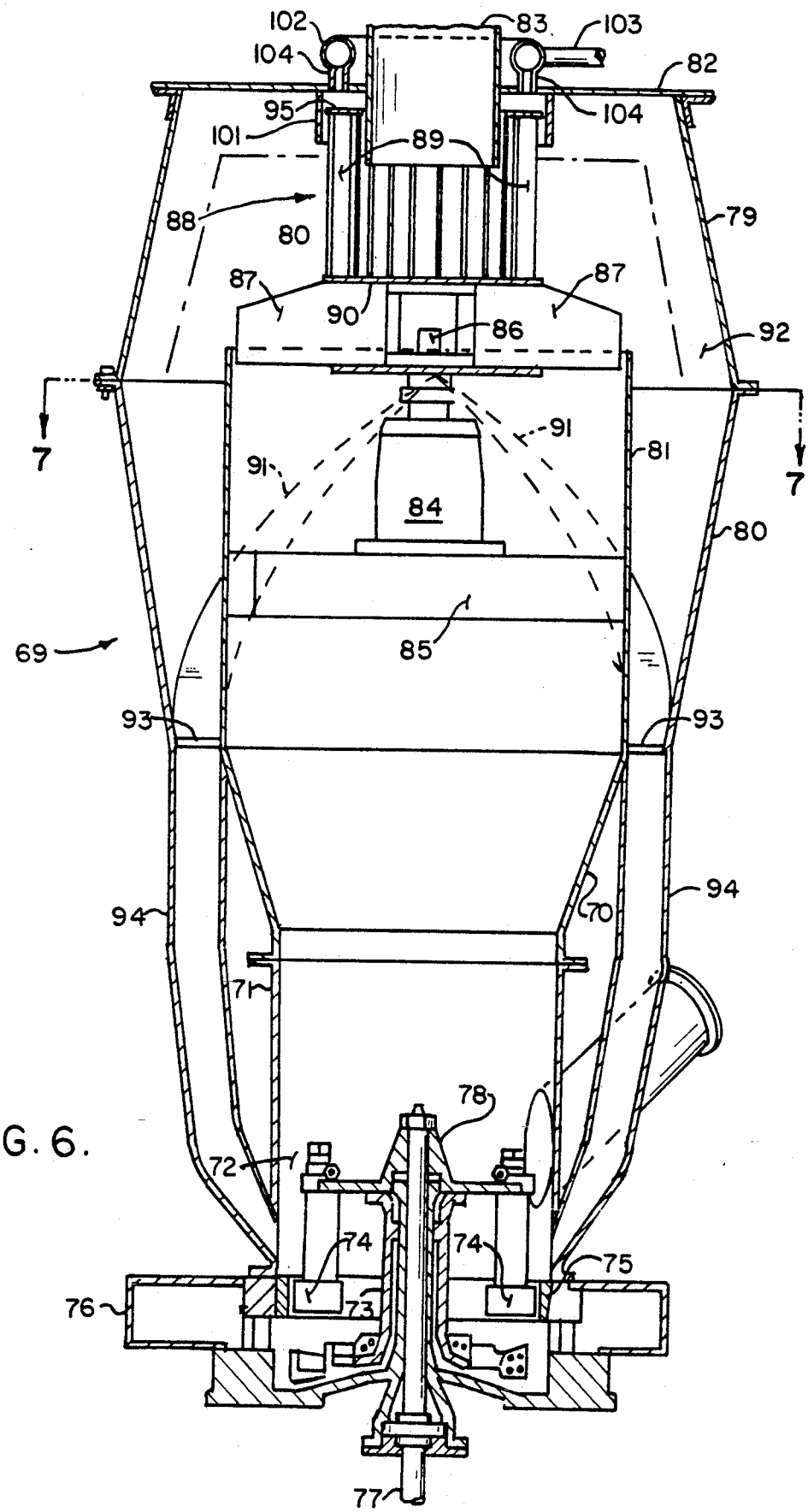
FIG. 6 is a schematic view of still another embodiment of apparatus for obtaining reduction of material to micron size.

In FIG. 1 the material grinding means 10 forms an enclosure that is suitable to receive a hammer rotor 11 revolving in a cage 12 so that the revolving hammers 13 throw the material upwardly through a material receiving passage 15 which is formed with a venturi section 16 positioned below a material feed conduit 17 which houses a conveyor screw 18 driven by motor 19 for moving the material deposited in the hopper 20 into the passage 15.

The enclosure 10 supports a centrifugal separator device 21 mounted on the passage 15. The device 21 is constructed with an enlarged casing 22 surrounding an internal cylindrical partition 23 having openings 24 which communicate with an interior space 25. That casing 22 is closed by a top 26 which is shaped to gather the particles that move through the space 27 and flow through conduit 28 which is connected to the suction inlet of blower 29 for discharge from the system.

The space 25 inside casing 22 and surrounding the cylindrical partition 23 is adapted for the collection of oversize and insufficiently reduced material. Thus, the case is formed with a tapering skirt 30 that directs the collected material into a discharge passage 31 associated with the enclosure 10 for reentry to the hammer mill 11, thereby preventing the possible reentering of the oversize material into the air system of inner passage 15.

The separator device 21, seen in FIGS. 2 and 3, is rendered operative by the mounting of a rotary impeller 32 having a series of radially directed blades 33 which have a special compound curved surface 34 that is axially wider at the root near the axis X—X of rotation and tapers radially outwardly to tip portion moving in a circular path opposite the opening 24 in the partition 23. The curved surface 34 has a shape that will, in other words, offer an enlarged surface (FIG. 2) near the root end adjacent the driven shaft 35 and that surface narrows as it progresses outwardly to tip surface. The blade surfaces 34 are impacted by the large or oversized particles so the rotor impeller 32 has some energy imparted to it on impact. However, one source of rotational effort is obtained first by the air flow generated by blower 29 drawing air from conduit 36 through passage 15 into space 27, and thence through conduit 28 and cyclone separator 41 associated with the blower 29. Secondarily, the impeller 32 is connected up with a motor 38 driving a shaft 39 through a suitable gear box 40. The shaft 39 operates through a gear box 40 to drive the rotor 32 mounted on the shaft 35.

The rotor 32 comprises (See FIGS. 1 and 2) a hub 35 mounted on the shaft 36. The hub has a base disc 36A and a top disc 36B. The respective blade elements 33 have inner projections 37 welded to the top disc 36B and to the base disc. The projections are spaced apart to leave an open space to reduce weight.

A suitable motor 41 is understood to drive the hammer rotor 11, and a separate motor (not shown) drives the blower 29. The air flow generated by the blower 29 lifts the material into the rotor 32 where desirable small particles pass through the rotor blades 33, while the larger particles impinge on the blades 33 and are guided radially outwardly toward the blade tips and pass into the casing space 25 where they fall by gravity through the funnel shaped skirt 30 and reenter the hammer cage 12. In order to utilize the rotor effectively as a separator, or particle size discriminator, the blades 33 have the surfaces 34 thereof given a compound curved shape so that the air impelled small particles can pass because the rotational speed is selected such that the small particles see only the space between blades, while the larger particles are intercepted and strike the blade surfaces 34 with the result referred to above.

In order for the desired size of particles to pass through the rotor 32 and collect in the cyclone 41, the velocity of the air flow and the rotational speed of the blades 33 need to be coordinated. One coordination is obtained by driving the blower 29 while allowing the motor 38 and gear box 40 to run free so the rotor 32 responds to the air velocity. The view of FIG. 3 is taken looking down on the top of the rotor 32 while the air flow is upward from below the rotor 32. Thus, the air drives the rotor 32 in a counter-clockwise direction, and the speed of rotation is a function of the velocity of the air stream. That velocity needs to be adjusted at the blower 29 until the particles that pass the rotor blades 33 retain the desired isokinetic reaction. That is to say that the motion of the particles across the blades 33 is substantially the same all along the radial length of the blades. Thus, particles at the root end of the blades and at the tip end of the blades move at substantially the same velocity, or have the same motion, hence the isokinetic action is achieved. Any particles of sizes that are unable to respond to the isokinetic action will be displaced radially along one or more of the blades 33 and be centrifuged through openings 24 and pass into the annular space 25 and fall back into the hammer rotor 11 for further size reduction.

A suitable control for the motor 38 can be programmed to either speed up the rotor 32 or slow its speed with the result that particle size passing the rotor 32 can be substantially predetermined. Furthermore, by controlling the speed of the rotor 32, and employing the flow of air through the device 21, there is gained a saving in the horsepower required to effect the process of reducing the particle size of the material fed into the mill at the feed conduit 17, as well as the oversized recirculated material collected by the skirt 30.

FIG. 4 is a modification of the schematic disclosure in FIG. 1 where similar reference character will be applied to denote similar parts. The difference resides in employing a blower 29A connected to conduit 36 for forcing air into the enclosure 10 where the hammer rotor is situated. The conduit 28A in this embodiment delivers the desired fines to a convenient place (not necessary to show) of delivery. In either embodiment of FIGS. 1 and 4, the rotor 32 assists the blower 29 or 29A in moving the air through the system, and at the same time, the rotor blades 33 centrifuge the oversize material out of the flowstream of the desired fines. By controlling the speed of the rotor drive motor 38 the rotor 32 aids the work of the blower 29 or 29A in moving the output of the mill, and the centrifuged oversize material is removed to the outside so that there is a significant reduction in the drag in the system.

Turning now to FIG. 5, a further embodiment of apparatus is shown. In this view, the enclosure 45 receives a roller mill assembly 46 having the usual air supply bustle 47, and a material feed inlet 48 provided with a rotary gate 49. A drive motor (not shown) is connected to the drive shaft 50 for driving the grinding rollers 51 relative to the bull ring 52. The air lifted ground material enters the separator device 53 at inlet 54 and is drawn into the discharge conduit 55 by the suction effect of the blower 56 associated with a cyclone separator 57. The details of the roller mill are shown in my U.S. Pat. No. 4,522,343 and incorporated here by reference.

The separator device is constructed with an outer casing 58 that surrounds a cylindrical partition wall 59 which encloses a rotor of the type seen in FIG. 2. The rotor 53 may be driven by a motor 60 operatively connected through a transmission 61 to the rotor shaft 62. The rotor 53 has the radially directed blades 63 which have the before mentioned compound curved surfaces that are thicker adjacent the axis of rotation and taper to thinner outer tips which move in an orbit adjacent the opening 64 in the partition wall 59. The oversize particles are centrifuged and pass through the opening 64 and collect in space 64A in the outer casing 58. The collected material in casing 58 drops by gravity into the chute 65 where it is guided into the inlet 48 so as to return such oversize material to the roller mill 46 for further reduction. Although not necessary to show, an alternate to the chute 65 can be formed to enter the mill 45 at a side wall 66 which would guide the oversize material into the orbit of the rollers 51.

The operation of the mill 45 and separator device 53 is obtained by the blower 56 drawing air into the bustle 47 where the upward flow tends to drive the device 53 so that a reduction in the power supply to motor 60 is experienced. Since the blades 63 are formed with a compound curvature, the fines are able to pass through to the discharge conduit 55, while the oversize particles impinge on the blades are expelled at opening 64 and assist in effecting rotation of the rotor as pointed out above. The rate of rotation of rotor 63 can be controlled by the speed of motor 60 to select particle size to be released into the discharge conduit 55.

The dynamics of the apparatus seen in FIGS. 1 and 5 is such that the movement of the desired size of particles across the surfaces of the rotor blades 33 or 63 is substantially uniform at any place along the radial length of the blades. By giving the blades a compound curved shape, as indicated in FIG. 3, the oversize particles are caused to move radially along the blades and be discharged into the space outside the passage between the grinding mill and the separator passage. Thus, there is eliminated the heretofor gravity movement of the oversize particles in countercurrent flow to the rising flow of the ground material leaving the grinding mill. An advantage of separating the movement of the returning oversize from the air lifted ground material that is made up of both fine and oversize particles is a reduction in the power input at the rotary separator. A further advantage is that for light weight material the system can depend upon the external blowers, either 29, 29A or 56, creating a sufficient air flow to spin the rotor blades in a free wheeling manner to effect the separation of the oversize from the fines in the movement of the column of material discharged by the grinding apparatus. For material of a solid and weighty character, the rotor separators will require being driven by the respective motors 38 or 60, as the case may be, so that the capacity of the output of the system can be improved by the centrifuging of the oversize material to make a significant reduction in the drag in the flow that would be associated by having the oversize material remain in a counterflow relation with the desired fines.

Turning now to FIG. 6 there is seen a further embodiment of apparatus 69 for grinding material to a micron fineness in several stages, depending on the characteristic of the components assembled in the upper end of the vertical casing 70. That casing 70 is mounted on top of the mill frame 71 which houses a typical roller mill assembly having a material grinding chamber 72 equipped with a roller drive pylon 73 on which are pivotally mounted a plurality of rollers 74 working against the usual bull ring 75. The mill assembly includes a wind box 76 surrounding the chamber 72 adjacent the rollers to air lift the ground material. A motor driven shaft 77 extends upwardly in the pylon to connect with the rotary head 78.

The important characteristics of the apparatus 69 in FIG. 6 is the formation of the shape of the casing 70 to form upper slanted wall 79 which merges with lower reversely slanted wall 80. Walls 79 and 80 enclose the inner cylindrical wall 81 which forms an internal passage surrounded by and spaced from the outer casing which has opposed slanting walls 79 forming the top portion of the outer casing 70. That casing has inwardly directed or converging bottom walls 80. The casing 79 is intended to have a cover 82 to locate an outlet conduit 83. The cylindrical wall 81 supports a motor 84 on a suitable support 85. The motor drive shaft 86 connects to impeller assembly consisting of a plurality of blades 87. Above the impeller assembly is a cylindrically directed cage 88 having a series of blades 89 supported on a bottom disc 90 connected to the impeller assembly.

In FIG. 6 an important characteristic is the arrangement of an interior cylindrical wall 81 which carries at its upper end the impeller assembly of blades 87 driven by the motor 84 supported on member 85. That wall 81 is enclosed by the outer casing 79-80, and specifically the outwardly expanded conical wall 79 and the cooperating downwardly converging wall 80 which has a tapering closure wall closure 91 forming the bottom of the space 92. Thus the formation of walls 79 and 80 have a bottom closed by the curved walls 91 that are directed around the outside of the cylindrical wall 81. The curved wall 91 and the converging wall 80 are shaped to form a downwardly directed outlet 93 at each side of the inner wall 81. Each outlet 93 is connected to a conduit 94, and those conduits 94 open into the lower end of the chamber 72 to direct the returning oversize particles into the orbit of the rollers 74 for further grinding.

Figure 7:
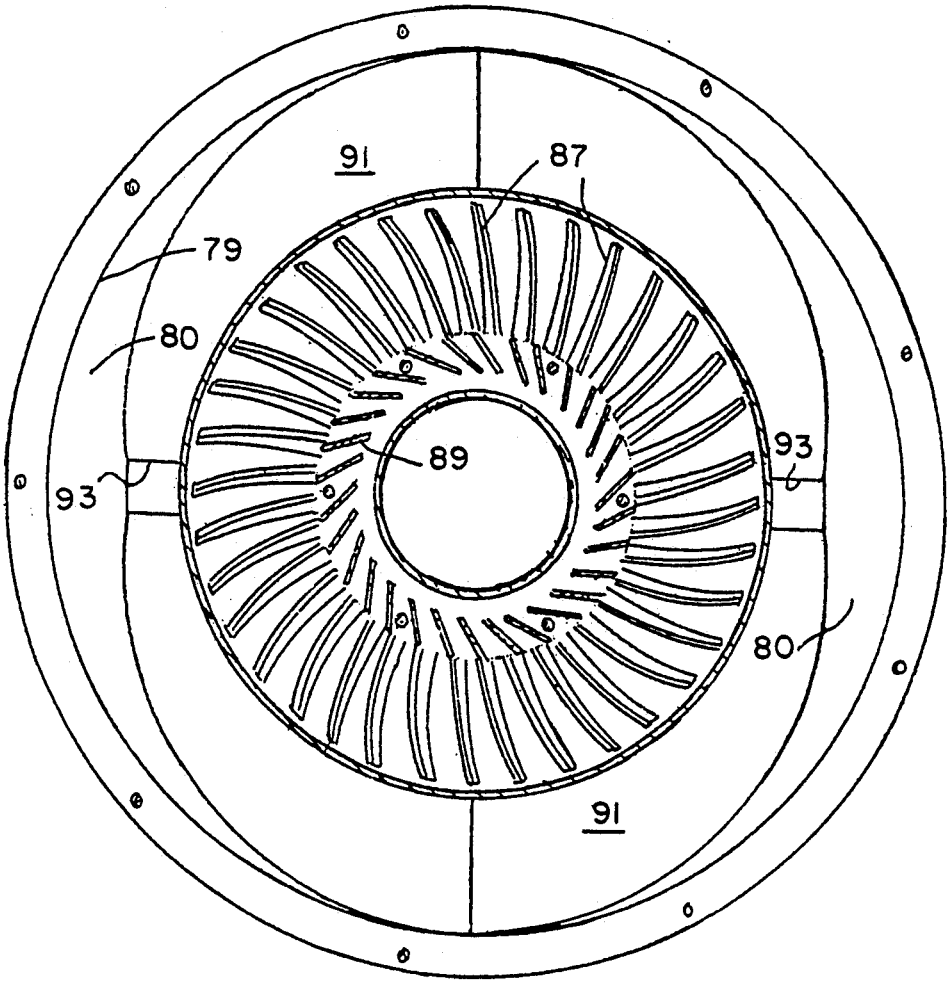
FIG. 7 is fragmentary transverse view of a rotary fan seen at line 7—7 in FIG. 6.

The impeller blades 87 support a disc 90 which carries a particle sizing cage 88 having an annular top disc 95 so that these two components 90 and 95 rotate together with a series of blades 89 between them. As is seen in FIGS. 6 and (on a larger scale) FIG. 7, the array of blades 87 are spaced from the outer casing wall 79. In FIG. 7, the cage 88 is formed with a series of flat blades 89 held at the tops by an annular ring 95. The bottom of the cage 88 is formed by a flat disc 90 engaged on the rotor blades 87. It can be appreciated that blades 87 are directed in a curved configuration that is opposed to the direction of the angular position of the blades 89. The effect of the differing positions of the blades 89 and 87 is to form a path through the assembly which presents a surface that bumps against the particles moving upwardly inside the cylindrical wall 81 and directs the bumped particles radially outwardly while only the flow of the particles having a desired micron size get through the cage 88 and escape at the outlet 83.

The cooperating action between the rotor 87 and the blades 89 in cage 88 is such that the rotor blades 89 create the isokinetic action which allows the smaller particles to pass through into cage 88 while the larger particles are displaced by the rotor blades 87 radially outwardly into space 92 where they are pressurized to move down into the outlets 93. The small particles passing the rotor 87 encounter the surfaces of the reversely angled blades 89 in the rotating cage 88. The action of the cage 88 is to present the blades 89 in such a way that the oversized particles bounce off the blades 89 while the finer particles pass through and flow through the outlet 83. Thus the desired cooperation of rotor blades 87 and cage 88 is to separate out the particles that have not been sufficiently reduced in size and pass the micron sized particles that are one hundred percent minus 30 micron size. The larger sized particles are all retained in the space 90 where they are subject to the differential pressure between space 90 and the mill space 72 which is sufficient to move them down to the grinder through the outlets 93 and conduits 94 (see FIG. 6).

Figure 8:
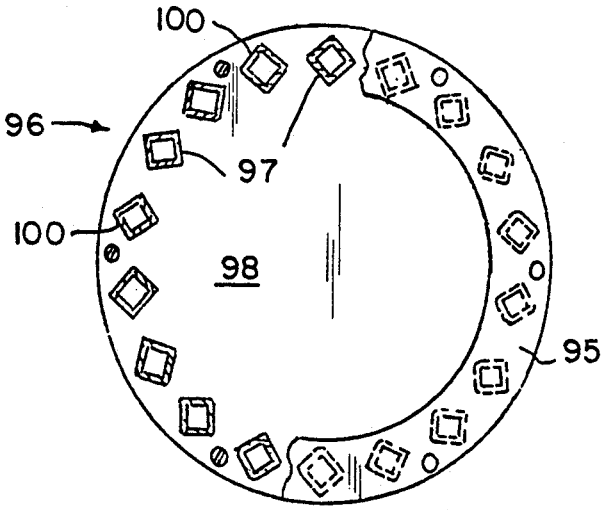
FIG. 8 is a fragmentary view taken at line 8—8 in FIG. 6 of a further rotary separator device.

The apparatus is capable of producing material reduced to a size of the order of minus 44 micron by substituting the flat bladed cage 88 for a cage 96 having a series of square bars 97, as shown in FIG. 8. Cage 96, like cage 88, employs the flat bottom disc 90 and top flat ring 95. The bars 97 are orientated so the flat surfaces 100 are presented to the flow of particles in space 92 from the rotor 87. The bars 97 are circumferentially spaced a distance sufficient to pass particles of minus 44 microns.

In view of FIG. 6, the minus 44 micron particles flow through outlet conduit 83 from the interior of the cage 88. The assembly of the cage 88 is provided with a collar 101 which closely encloses the top flat ring 95 to provide an annular space around the outlet 83. That space is maintained under a suitable air pressure from a pipe 102 which is supplied with air from a connection 103 to any convenient source of air. The pipe 102 has several branch connections 104 opening into the annular space inside the collar 101.

The foregoing disclosures have set forth descriptions of various forms of apparatus that are believed to be examples of the preferred mode of carrying out the invention, and an understanding of that best mode is to be found in the foregoing specification.

What is claimed is:

1. In material separator apparats for classifying ground material discharged from a grinding zone into fine and oversize photons, the improvement comprising:

a) material grinding means having an inlet for receiving material to be ground and an outlet for ground material;

b) an isokinetic rotary classifier means operably connected to said outlet of said grinding means for receiving the ground material to be classified between the fine and the oversize portions;

c) enclosure means for said rotary classifier means having an outlet being formed with an internal space in which the ground material is classified, and an external space communicating with said internal space and with said material grinding means; and d) air moving means associated with said rotary classifier means for creating a flow of material through said grinding means and said rotary classifier means, said flow being effective to establish a force to rotate said rotary classifier means at a velocity for passing said fine portions through said enclosure means outlet and centrifuging the oversize material portions into said external space for return to said material grinding means to be reground.

2. The improvement set forth in claim 1 wherein said isokinetic rotary classifier means is a rotor having blades movable in a horizontal path and shaped to provide surfaces which pass the fine material portions to said enclosure means outlet and direct the oversize portions into said external space.

3. The improvement set forth in claim 1 wherein motor means is operably connected to said isokinetic rotary classifier means for assisting said air moving means in the passing of the fine material portions through said enclosure means outlet.

4. Material classifying apparats for receiving ground material from a material grinder and classifying the material between fines and oversize particles, said apparatus comprising:

a) material grinder means having an outlet for the ground material and an inlet to receive material to be ground;

b) classifier means connected to said grinder means outlet, said classifier means including an enclosure forming an inner passage and a material collection space outside of said inner passage, a bladed rotor operably carried by said enclosure, and said enclosure having an outlet for classified material having a desired fineness;

c) means connecting said grinder means with said material collection space; and d) air moving means connected to said apparatus for moving the ground material from said grinder means into said classifying means and for driving said bladed rotor for separating the ground material into a class of desired fineness for discharge through said outlet of said enclosure and a class of oversize particles for removal into said collection space for reducing obstruction to the movement of the ground material of desired fineness from said grinder means.

* * * * *

UNITED STATES PATENT AND TRADEMARK OFFICE

CERTIFICATE OF CORRECTION

PATENT NO. : 5,279,466

DATED : January 18, 1994

INVENTOR(S) : Robert M. Williams

It is certified that error appears in the above-identified patent and that said Letters Patent is hereby corrected as shown below:

In the claims

Column 7, line 26 "photons" should be --- portions ---

Signed and Sealed this

Twenty-fourth Day of May, 1994

Bruce Lehman

*Attest:*

BRUCE LEHMAN

*Attesting Officer*

*Commissioner of Patents and Trademarks*